US005947342A

United States Patent [19]

Song

[11] Patent Number: 5,947,342

[45] Date of Patent: Sep. 7, 1999

[54] REFRIGERATOR ICE SUPPLYING APPARATUS

[75] Inventor: Yo-Hyun Song, Suwon, Rep. of Korea

[73] Assignee: Samsung Electronics Co., Ltd., Suwon, Rep. of Korea

[21] Appl. No.: 09/058,779

[22] Filed: Apr. 13, 1998

[30] Foreign Application Priority Data

May 17, 1997 [KR] Rep. of Korea ..... P97-19153

[51] Int. Cl.[6] ..... F25C 5/16

[52] U.S. Cl. ..... 222/413; 222/146.6; 222/227; 222/240; 62/320; 62/344

[58] Field of Search ..... 222/146.6, 413, 222/239–242, 227; 62/320, 344

[56] References Cited

U.S. PATENT DOCUMENTS

| | | | |
|---|---|---|---|
| 3,640,088 | 2/1972 | Jacobus et al. | 222/146.6 |
| 3,902,331 | 9/1975 | True, Jr. et al. | 222/413 |
| 4,189,063 | 2/1980 | Matthiesen | 222/413 |
| 4,619,380 | 10/1986 | Brooks | 222/413 |
| 4,627,556 | 12/1986 | Brooks | 222/413 |
| 5,050,777 | 9/1991 | Buchser | 222/146.6 |
| 5,056,688 | 10/1991 | Goetz | 222/146.6 |

*Primary Examiner*—J. Casimer Jacyna
*Attorney, Agent, or Firm*—Burns, Doane, Swecker & Mathis, L.L.P.

[57] ABSTRACT

A refrigerator ice supplying apparatus having an ice storing box mounted for receiving ice dropping out of ice makers and a rotary shaft disposed in the storing box for being simultaneously rotated along with a motor, the apparatus comprising a volume reducing unit installed at a front portion of an ice supply container for being moved along with the rotary shaft and for securing a predetermined amount of ice to be supplied by reducing an ice inducing area even if the ice supply container is shortened in its length, whereby an area, where the supply container is to be occupied in the storing box, is reduced with an increase of ice storing capacity and whereby the number of the ice supply container is reduced to diminish its manufacturing materials.

2 Claims, 3 Drawing Sheets

REFRIGERATOR ICE SUPPLYING APPARATUS

BACKGROUND OF THE INVENTION

1. Field of the Invention

The present invention relates to a refrigerator ice supplying apparatus.

2. Description of the Prior Art

A conventional refrigerator is designed to store foodstuffs for a long period of time by using a freezing cycle of a refrigerant. The refrigerator includes a refrigerating chamber (not shown) for storing foodstuffs in a non frozen state for a short period of time and a freezing chamber (P) for freezing and storing foodstuffs for a long period of time.

The freezing chamber, as shown in FIG. 1, is provided with a door rotatively installed at its front portion with an ice dispenser (50) made of an insulating material like a styrofoam, a case (52) for forming a structure of the freezing chamber (P), a compressor (55) disposed under the case (52), first and second ice makers (56, 57) mounted at middle and upper portions of the freezing chamber (P), a plurality of shelves (59) supported on a plurality of guide rails (58) formed on the lateral walls and a plurality of storing boxes (60).

The ice dispenser (50) is provided with a receiver (61) formed at an external side of the door (51), a discharge tube (62) vertically installed inside the door (51), a dispenser lever (64) rotatively hinged at a lower end of the discharge tube (62) with a hinge (63) and a switch (65) positioned on the door (51) for being turned on when the dispenser lever (64) is moved.

Particularly, an ice supplying apparatus is installed under a first ice maker (56) for breaking up ice and for supplying a predetermined amount of the ice to the discharge tube (62) of the ice dispenser (50).

The ice supplying apparatus (disclosed in U.S. Pat. No. 4,627,556) includes a motor (67) supported on a guide rail (58) and on a cover (66), a rotary shaft (68) spirally formed for sending ice in a continuous movement along with the connected motor (67), a group of two cylindrical supply containers (70) installed at an end of the rotary shaft (68) with a plurality of spiral blades (69) for sending a predetermined amount of ice, a crusher (72) having a plurality of cutters which are rotated along with the rotary shaft (68) for breaking up ice sent from the supply containers (70) into smaller pieces and a storing box (73) for covering a few mechanical parts and for storing the ice.

The first and second ice makers (56, 57) are respectively provided with water supply tubes (74) for supplying a predetermined amount of water thereto to be frozen into ice and a cover (75) at a front portion of the storing box (73).

If the freezing chamber (P) is filled with cold air by a compressor (55) and an evaporator (54) of the refrigerator, the water supplied through the water supply tubes (74) into the first and second ice makers (56, 57) is frozen into ice.

Then, the ice formed in the first and second ice makers (56, 57) is dropped out through an upper opening of the storing box (73) when the ice containers of the first and second ice makers (56, 57) are rotated, whereby a predetermined amount of ice is kept stored in the storing box (73).

If the dispenser lever (64) is depressed by a user to get ice, the lever (64) is rotated around the rotary shaft (67) and the switch (65) is simultaneously turned on. If the switch (65) is turned on, the motor (67) rotates to simultaneously drive the rotary shaft (68) to thereby supply ice to the supply container (70).

The ice in the supply container (70) is supplied in a predetermined amount to the crusher (72) by the blades (69). The ice at the crusher (72) is broken up to small pieces by the cutters (71) if the small pieces of ice are needed by the user. Then, the crushed ice pieces are supplied to a discharge tube (62) through the crusher (72) for use by the user.

At this time, two supply containers (70) are used as a group to prevent the ice which has passed through the supply container (70) from being abruptly transported to the crusher (72). In addition, a group of two supply containers (70) as opposed to one supply container is more effective in extending a stroke distance where ice is to be moved by blades (69) of the supply containers (70). Therefore, stability of supplying ice to the crusher (72) is improved because the stroke distance of ice to be moved by the blades (69) at a predetermined speed and at a predetermined amount is increased. The stable supply of ice to the crusher (72) makes it more convenient to control the amount of ice to be discharged through the ice dispenser.

However, there is a problem in the conventional refrigerator ice supplying apparatus in that the provision of two supply containers for transporting ice is bulky, thereby reducing storing capacity in the storing box and increasing manufacturing cost.

SUMMARY OF THE INVENTION

The present invention is presented to solve the aforementioned problem and it is an object of the present invention to provide a refrigerator ice supplying apparatus with increased ice storing capacity and with reduction of manufacturing materials.

In order to achieve the object of the present invention, there is provided a refrigerator ice supplying apparatus having an ice storing box mounted for receiving ice dropping out of ice makers and a rotary shaft disposed in the storing box for being simultaneously rotated along with a motor, the apparatus comprising:

volume reducing means installed at a front portion of an ice supply container for being moved along with the rotary shaft and for securing a predetermined amount of ice to be supplied by reducing an ice inducing area even if the supply container is shortened in its length.

BRIEF DESCRIPTION OF THE DRAWINGS

For fuller understanding of the nature and objects of the invention, reference should be made to the following detailed description taken in conjunction with the accompanying drawings in which.

DETAILED DESCRIPTION OF THE INVENTION

Figure 1:
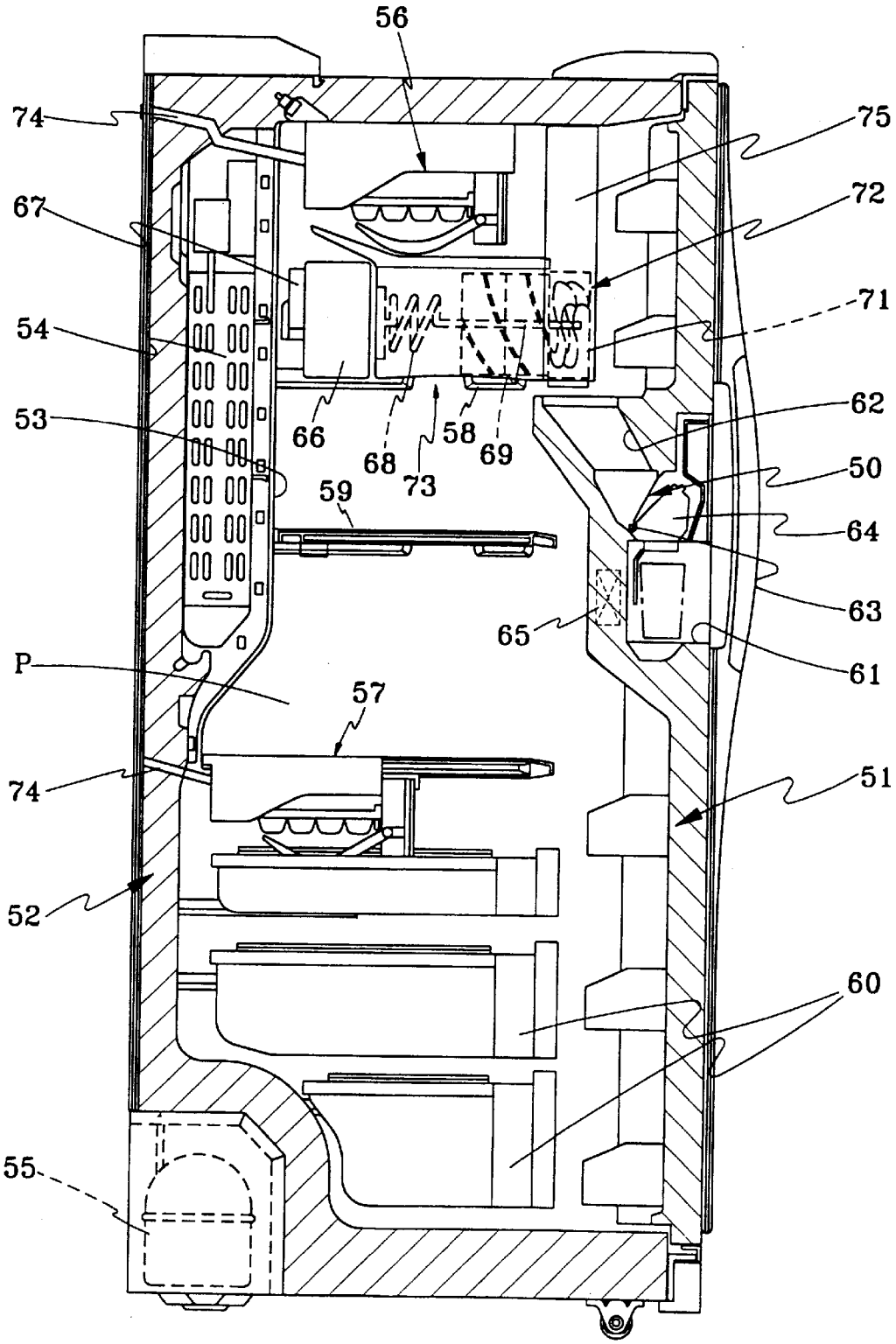
FIG. 1 (Prior Art)
FIG. 1 is a sectional view for illustrating a freezing chamber of a conventional large refrigerator.
Figure 2:
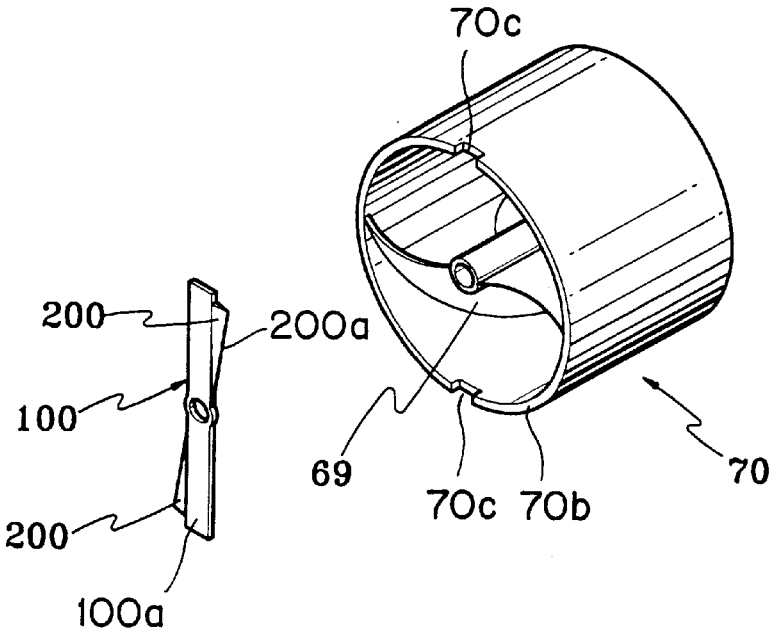
FIG. 2 is an analyzed perspective view for illustrating an important portion of a refrigerator ice supplying apparatus in accordance with the present invention.

A preferred embodiment of the present invention is described in detail with reference to the accompanying drawings. Throughout the drawings, like reference numerals and symbols are used for designation of like or equivalent parts or portions for simplicity of illustration and explanation, and redundant references will be omitted.

Figure 3:
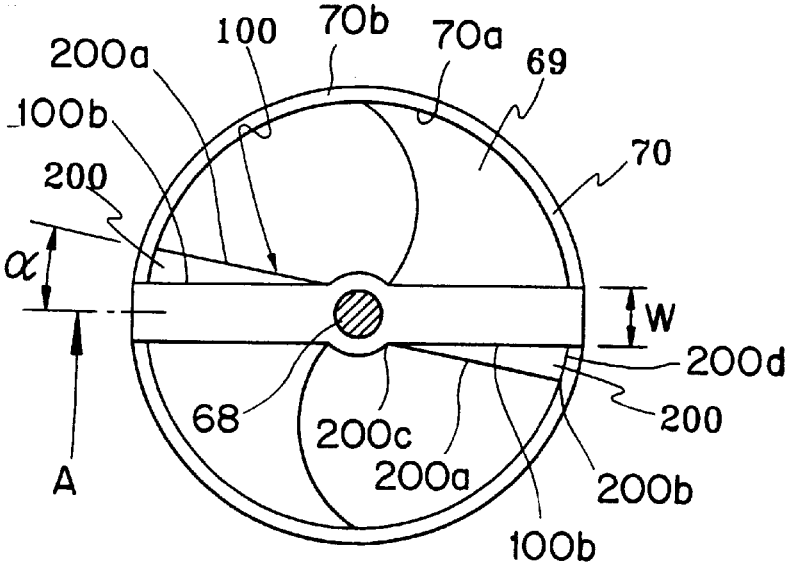
FIG. 3 is a front view for assembling of a refrigerator ice supplying apparatus in FIG. 2.
Figure 4:
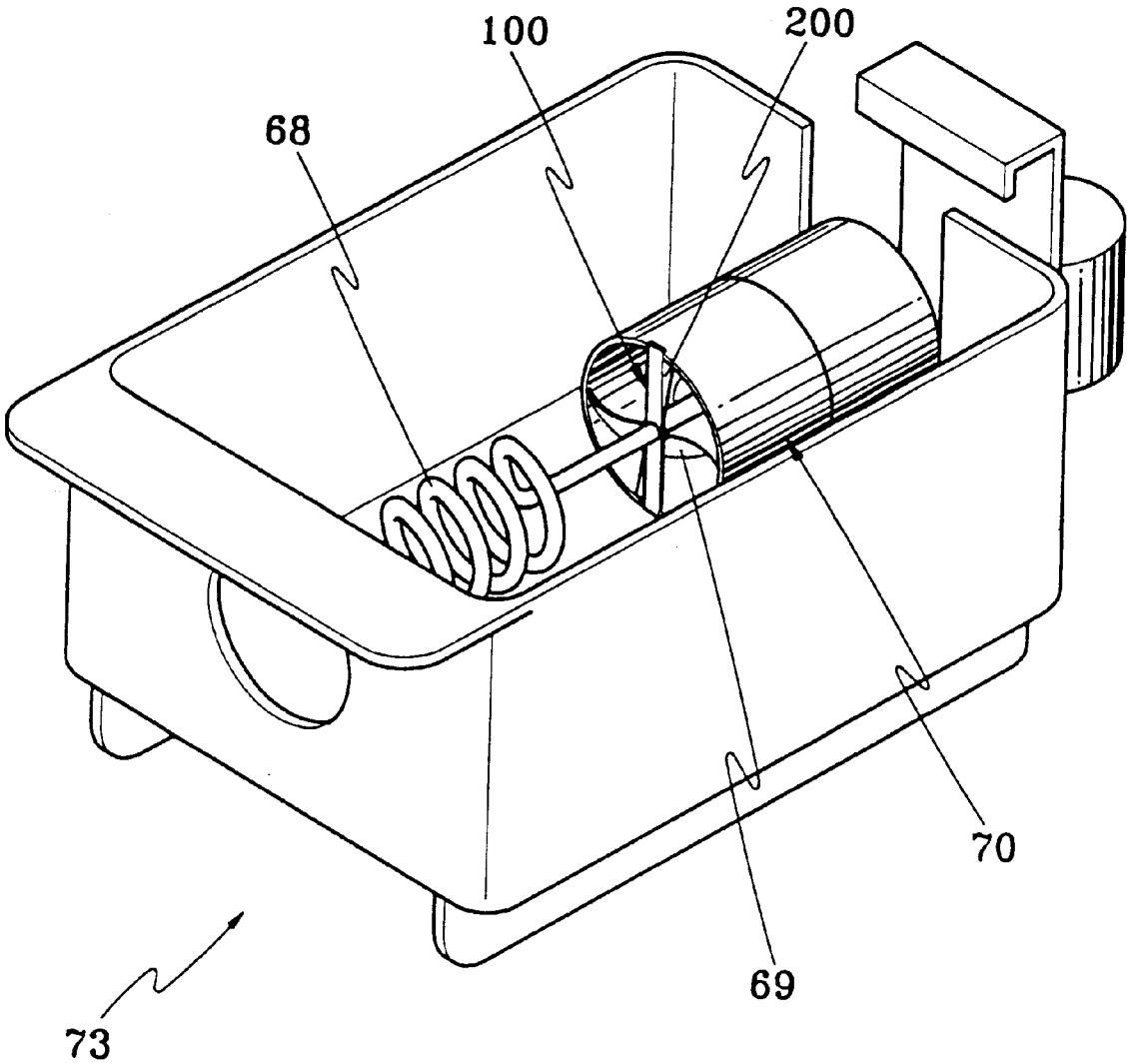
FIG. 4 is a perspective view of a refrigerator ice supplying apparatus in accordance with the present invention.

FIGS. 3 and 4 are schematic diagrams for respectively illustrating perspective and front views of the refrigerator ice supplying apparatus in accordance with the present invention. Volume reducing means is provided at a front portion of an ice supply container (70) for securing a predetermined amount of ice to be supplied thereto by reducing its ice inducing part. The volume reducing means includes a blocking plate (100) for reducing an area of an opening formed at a front lateral portion of the supply container (70). The supply container includes a cylindrical inner surface **(70*a*), and a circular end edge (70*b*) having a pair of diametrically opposed notches (70*c*) formed therein. The blocking plate (100) includes a mounting body (100*a*) having a width w corresponding to a width of each notch (70*c*), whereby the notches receive respective portions of the mounting body. A center line A of the mounting body (100*a*) extends diametrically with respect to the shaft (68). The blocking plate further includes a pair of cutter bodies (200) disposed on respective leading edges (100*b*) of the mounting body, which edges are situated on opposite sides of the shaft (68). Each cutter body includes a cutting edge (200*a*) extending at an acute angle $\alpha$ relative to the center line A, whereby a radially outer end (200*b*) of each cutting edge (200*a*) is spaced farther from the center line A than is a radially inner end (200*c*) thereof, and whereby a radially outwardly facing edge (200*d*) of each cutter body opposes the cylindrical surface (70*a*) of the supply container (70)**.

Cutters (200) are fixed at lateral portions of the blocking plate (100) for making initial and total breakage of ice when ice is supplied to a front end of the supply container (70) by rotation thereof and for guiding the broken small ice pieces through the crusher (72) mounted at a rear end thereof.

The amount of the ice to be induced into the supply container (70) is reduced by the blocking plate (100), thereby preventing a sudden induction of ice into the supply container (70). Accordingly, the amount of ice to be supplied into the crusher (72) is reduced to thereby achieve a predetermined supply of ice.

Next, operational procedures and effects are described in detail. First of all, if a user depresses the ice dispenser lever (64) to use the ice dispenser (50) of the refrigerator having the blocking plate (100) at the supply container (70), the dispenser lever (64) is rotated around the rotary shaft (68).

If the dispenser lever (64) is rotated, the switch (65) and the motor (67) are simultaneously operated to thereby move a predetermined amount of ice stored at the storing box (73) to the crusher (72), where ice is broken up and dropped down to a discharge tube (62).

At this time, large lumps of ice forcibly transported by the rotary shaft (68) at the storing box (73) are to be stopped by the blocking plate (100) disposed at the front portion of the supply container (70) while smaller pieces of ice are to be induced through the opening of the supply container (70).

The two ice supply containers (70) as a group in the prior art were effective in supplying a predetermined amount of ice by extending a stroke distance of ice, while the blocking plate (100) in the present invention is effective in controlling an ice transporting speed whereby a predetermined amount of ice is to be induced into the supply container (70) in the storing box (73). The opening of the supply container (70) to be blocked by the blocking plate (100) is big enough to keep a predetermined supply of ice, but small enough to prevent a sudden transportation of ice.

If ice melted and frozen at the storing box (73) is to be induced into the supply container (70) by rotating rotary shaft (68), the cutters formed at both sides of the blocking plate (100) are used to cut ice into smaller pieces. In addition, ice pieces with smaller sizes cut by the cutters (200) are to be moved through the supply container (70) to the crusher (72) which has a more effective and stable function of breaking up ice.

Therefore, there is an advantage in the refrigerator ice supplying apparatus of the present invention in that only one ice supply container is used in a stable supply of ice into the crusher, thereby reducing the manufacturing materials.

What is claimed is:

1. A refrigerator ice supplying apparatus comprising an ice storage box for receiving ice pieces, a motor, a rotary shaft rotatable by the motor and disposed in the storing box for advancing ice, and a volume reducing mechanism disposed at an end of the shaft for receiving the advancing ice and discharging a predetermined amount of the ice, and an ice crusher arranged for receiving and crushing ice from the volume reducing mechanism, the volume reducing mechanism comprising:

an ice supply container fixed to an end portion of the shaft for rotation therewith, the supply container including an ice inlet end for receiving the advancing ice, and an ice outlet end for discharging ice to the ice crusher; and a blocking plate mounted for rotation with the shaft and the supply container, the blocking plate extending across the inlet end of the supply container for partially blocking the inlet end, the blocking plate including:

a mounting body having a center line extending diametrically with respect to the shaft, and a pair of cutter bodies rotatable with the mounting body for cutting ice pieces advancing through the inlet end of the supply container, the cutter bodies disposed on respective leading edges of the mounting body that are situated on opposite sides of the shaft, and each cutter body including a cutting edge extending at an acute angle relative to the center line of the body, whereby a radially outer end of each cutting edge is spaced farther from the center line than is a radially inner end thereof.

2. The ice supplying apparatus according to claim 1 wherein the supply container includes a cylindrical inner surface and a circular end edge; a pair of notches disposed in diametrically opposite locations of the end edge, each notch having a width substantially corresponding to a width of the mounting body and receiving a respective portion of the mounting body; each cutter body being stepped radially inwardly relative to a respective radially outer end of the mounting body, whereby a radially outwardly facing edge of each cutter body opposes the cylindrical inner surface of the supply container.

* * * * *